US006942459B2

(12) United States Patent
Li et al.

(10) Patent No.: US 6,942,459 B2
(45) Date of Patent: Sep. 13, 2005

(54) MODIFIED CENTRIFUGAL FAN WHEEL

(75) Inventors: Nien-Lun Li, Hsin-Chuang (TW); Fu-Yin Wang, Hsin-Chuang (TW)

(73) Assignee: Datech Technology Co., Ltd., Taipei Hsien (TW)

( * ) Notice: Subject to any disclaimer, the term of this patent is extended or adjusted under 35 U.S.C. 154(b) by 23 days.

(21) Appl. No.: 10/664,935

(22) Filed: Sep. 22, 2003

(65) Prior Publication Data

US 2005/0047916 A1 Mar. 3, 2005

(51) Int. Cl.[7] ..... F03B 3/12
(52) U.S. Cl. ..... 416/178; 416/187
(58) Field of Search ..... 416/178, 186 R, 416/187, 188

(56) References Cited

U.S. PATENT DOCUMENTS 1,699,201 A * 1/1929 Guth ..... 416/181
2,803,398 A * 8/1957 Sprouse ..... 416/187
2,870,959 A * 1/1959 Giddings ..... 416/188
3,692,428 A * 9/1972 Bubb et al. ..... 416/187
4,838,762 A * 6/1989 Savage et al. ..... 416/187
5,988,979 A * 11/1999 Wang ..... 416/178

FOREIGN PATENT DOCUMENTS

JP 59049395 A * 3/1984 ..... F04D/29/28
JP 03233196 A * 10/1991 ..... F04D/29/30

* cited by examiner

*Primary Examiner*—Edward K. Look
(74) *Attorney, Agent, or Firm*—Troxell Law Office, PLLC

(57) ABSTRACT

The modified centrifugal fan wheel comprises a hollow hub and a set of blade. A hollow hub axis is disposed at the center of a hollow portion of the hollow hub. Along a top side surface of the hollow hub is a curved guiding inlet part and along a bottom side surface of the hollow hub is a curved surface with a smooth fillet extending to a closed part. A set of blades is arranged around an outer part of the hollow hub, having an up ring and a down ring. An inner part of the down ring is connected to the closed part of the hollow hub. Blades are disposed between the up ring and the down ring. Wind holes are disposed equidistantly between each of the blades and equidistant perforations are arranged on the surface of the down ring, connecting to the wind holes between each of the blades. By the closed part and the perforation of the fan wheel, low noise and low current are provided. Meanwhile, power consumption is reduced and working performance of the fan wheel is also improved.

2 Claims, 10 Drawing Sheets

| | | Present invention | Prior art |
|---|---|---|---|
| Velocity (rpm) | | 6400 | 6400 |
| #1 | Sound Pressure (dB) | 64.5 | 68.8 |
| | Working Votage (A) | 2.30 | 2.48 |
| #2 | Sound Pressure (dB) | 64.5 | 68.6 |
| | Working Votage (A) | 2.24 | 2.53 |
| #3 | Sound Pressure (dB) | 64.5 | 68.7 |
| | Working Votage (A) | 2.25 | 2.51 |
| Average Sound Pressure (dB) | | 64.5 | 68.7 |
| Average Working Votage (A) | | 2.26 | 2.51 |

Remark :
1. Background : 16.6 dB
2. Temperature : 23 ℃

Fig. 8

MODIFIED CENTRIFUGAL FAN WHEEL

REFERENCE CITED

U.S. Patent No.: 2003/0143070A1

FIELD OF THE INVENTION

The present invention is related to a modified centrifugal fan wheel. More particularly, by a closed part and a perforation, during operation of the fan wheel, noise is reduced and the current value is lowered. Meanwhile, the power consumption for operation of the fan wheel is reduced and working performance is also improved.

BACKGROUND OF THE INVENTION

The structure of conventional fan wheel is shown in FIG. 9. The fan wheel has a hollow hub 4. A connecting part 41 is arranged in the bottom of the hollow hub 4, having a side extend to at least one blade 42. At least one perforation 43 is disposed between the hollow hub 4 and the blade 42 on the surface of the connecting part 41. Thus, a fan wheel is formed.

Although the fan wheel mentioned above can be fabricated in a fan case (not shown) in order to guide airflow, however, since both the top side of the hollow hub 4 and joint portion between the bottom side of the hollow hub 4 and the connecting part 41 are in a foursquare shape, when airflow blows from the top side of the hollow hub 4 toward the blades 42, no guiding structure is provided from the structure of the fan wheel. Therefore, the airflow entering into the top side of the hollow hub 4 will generate turbulence (as shown in FIG. 10), resulting in difficulty in outputting the air. Thus, it results in more power consumption and further worsens the performance. Since at least one perforation 43 is disposed on the surface of the connecting part 41 between the hollow hub 4 and blades 42, when airflow enters from the top side of the hollow hub 4 and blows toward the blades 42, in addition to the generated turbulence which results in airflow reduction, some part of airflow will blow out from the perforation 43 without being guided to the blades 42. Furthermore, airflow will generate considerable operation noise due to the perforation 43.

Furthermore, another prior art in the U.S. Pat. No. 2003/0143070A1 comprises:

a first set of blades composed of a plurality of blades;

a second set of blades composed of a plurality of blades; and a plurality of sliding portion, respectively connecting to each blades between said first set of blades and said second set of blades.

Although in the above U.S. Patent, the sliding portion between the first set of blades and the second set of blades is used to guide airflow, since it merely adds one sliding portion in the blades without reforming the whole guiding structure of the fan wheel, the guiding efficacy of the sliding portion is restricted and is insufficient to meet user's needs.

SUMMARY OF THE INVENTION

The main objective of the present invention is that by a closed part and a perforation, during operation of the fan wheel, the noise can be reduced and the current value will be lowered.

Another objective of the present invention is to reduce the power consumption during operation of the fan wheel, so as to further improve the working performance of the fan wheel.

To achieve the above objectives, the present invention provides a modified centrifugal fan wheel having a hollow hub. The hollow hub has a hollow portion. A hollow hub axis is disposed at the center of the hollow portion of the hollow hub. Along a top side surface of the hollow hub is a curved guiding inlet part and along a bottom side surface of the hollow hub is a curved surface with a smooth fillet extending to a closed part; and a set of blades, arranging around an outer part of the hollow hub, having an up ring and a down ring. An inner part of the down ring is connected to the closed part of the hollow hub. Blades are disposed between the up ring and the down ring. Wind holes are disposed equidistantly between each of the blades and equidistant perforations are arranged on the surface of the down ring, connecting to the wind holes between each of the blades. By the closed part and the perforation of the fan wheel, low noise and low current are provided. Meanwhile, power consumption is reduced and working performance of the fan wheel is also improved.

BRIEF DESCRIPTION OF THE DRAWINGS

The present invention will be better understood from the following detailed description of preferred embodiments of the invention, taken in conjunction with the accompanying drawings, in which

FIG. 8 is a noise value (db) comparison chart of the present invention and the prior art;

DETAIL DESCRIPTION OF THE INVENTION

The following descriptions of the preferred embodiments are provided to understand the features and the structures of the present invention.

Figure 1:
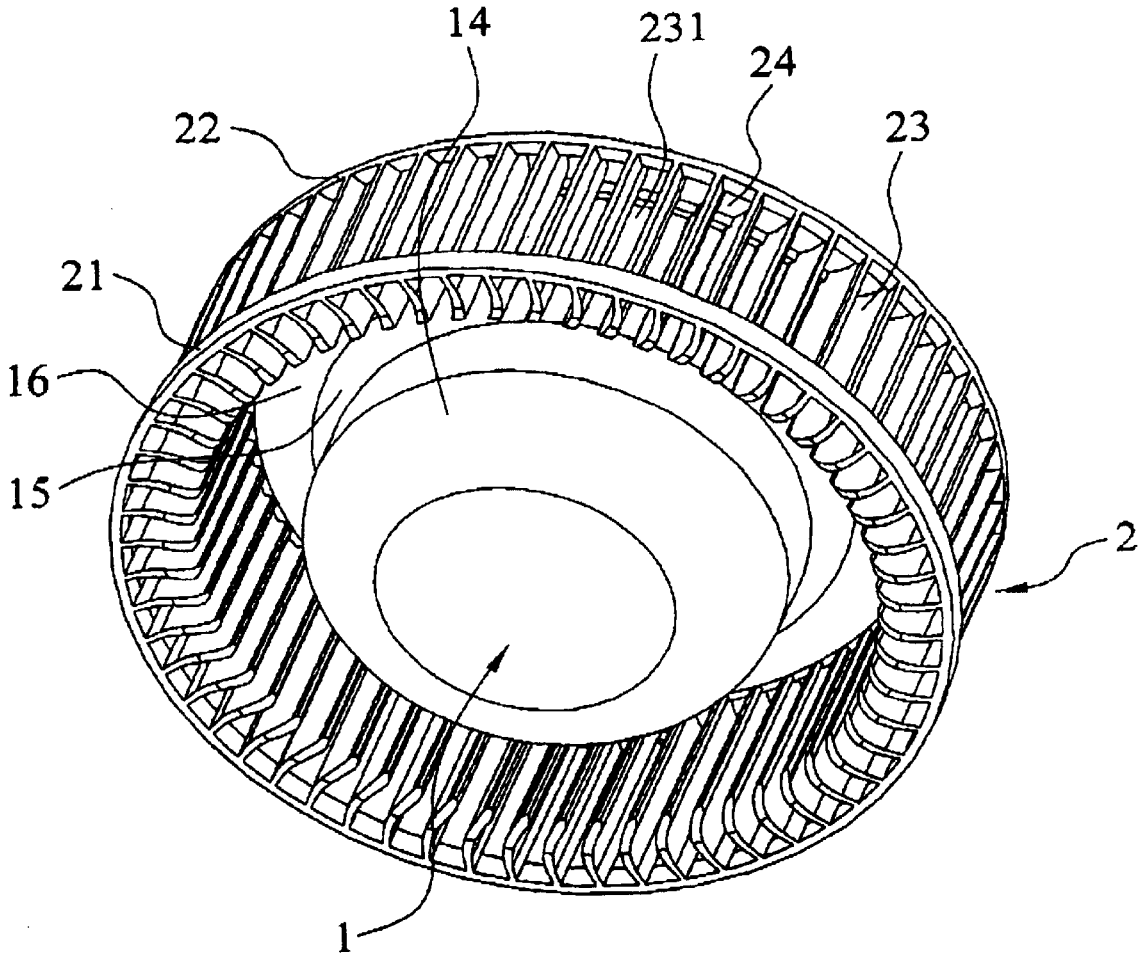
FIG. 1 is a diagram showing an outward appearance of the present invention.
Figure 2:
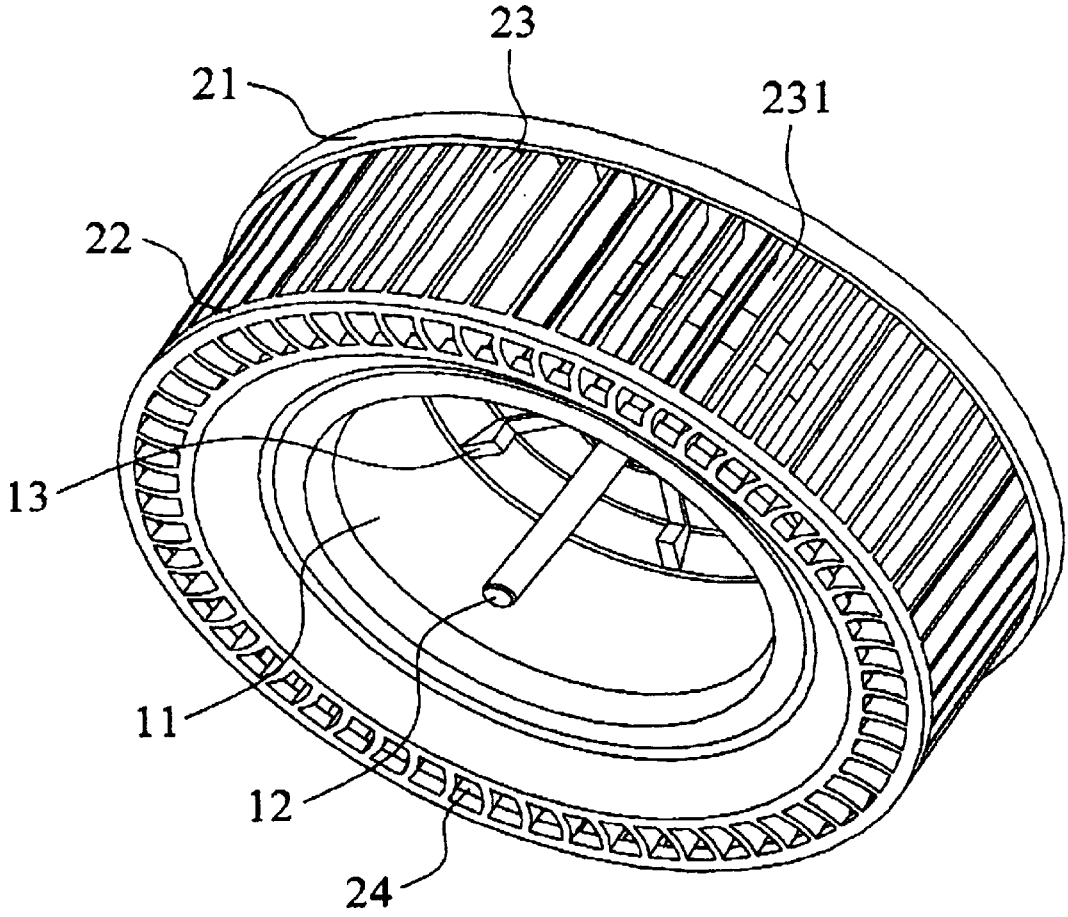
FIG. 2 is a diagram showing an outward appearance of the present invention viewing from a different angle.
Figure 3:
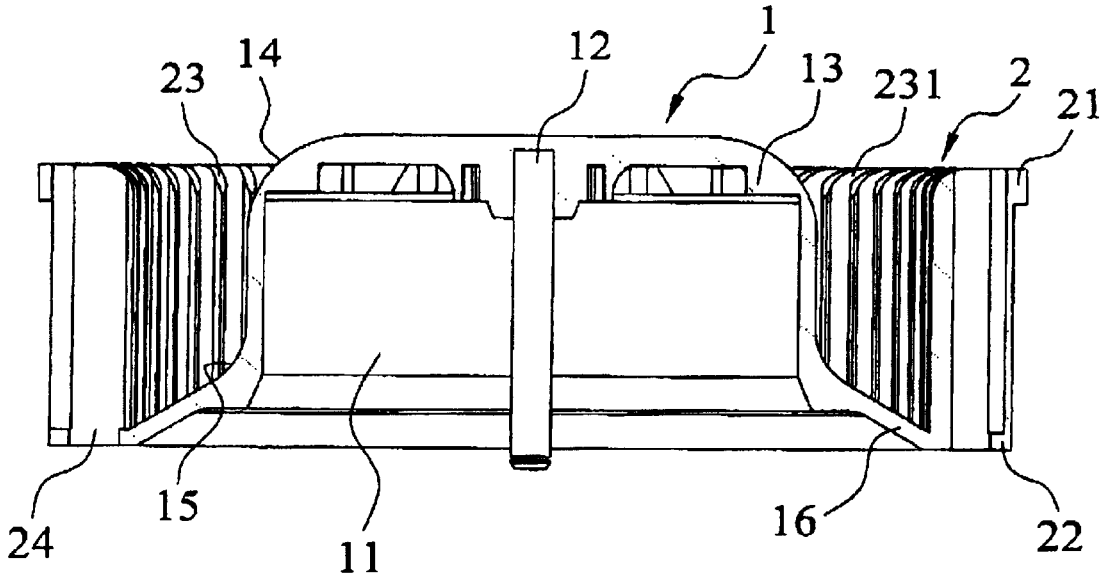
FIG. 3 is a cross-section diagram of the present invention.
Figure 4:
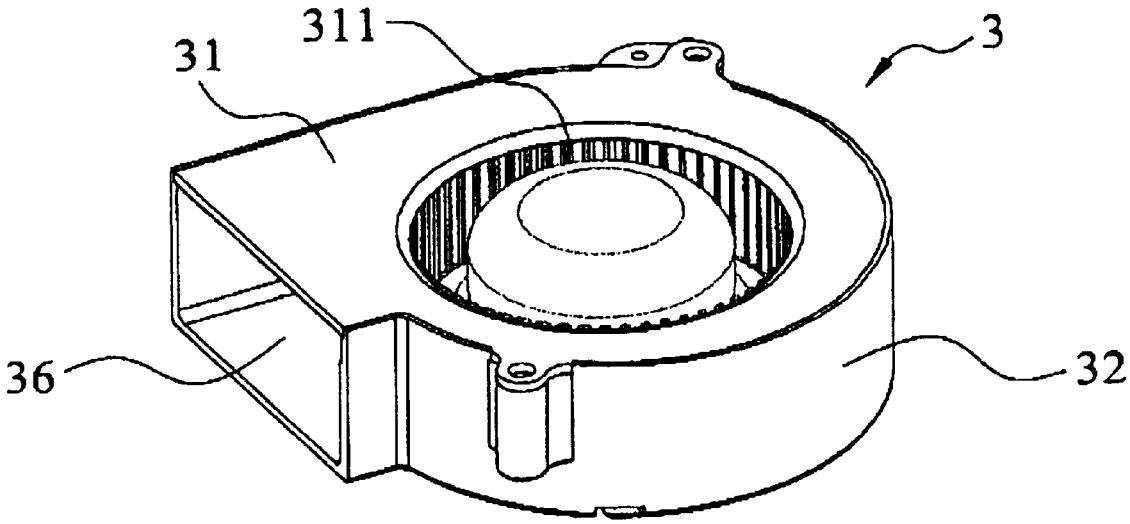
FIG. 4 is a diagram showing an outward appearance of the present invention fabricated in a case.
Figure 5:
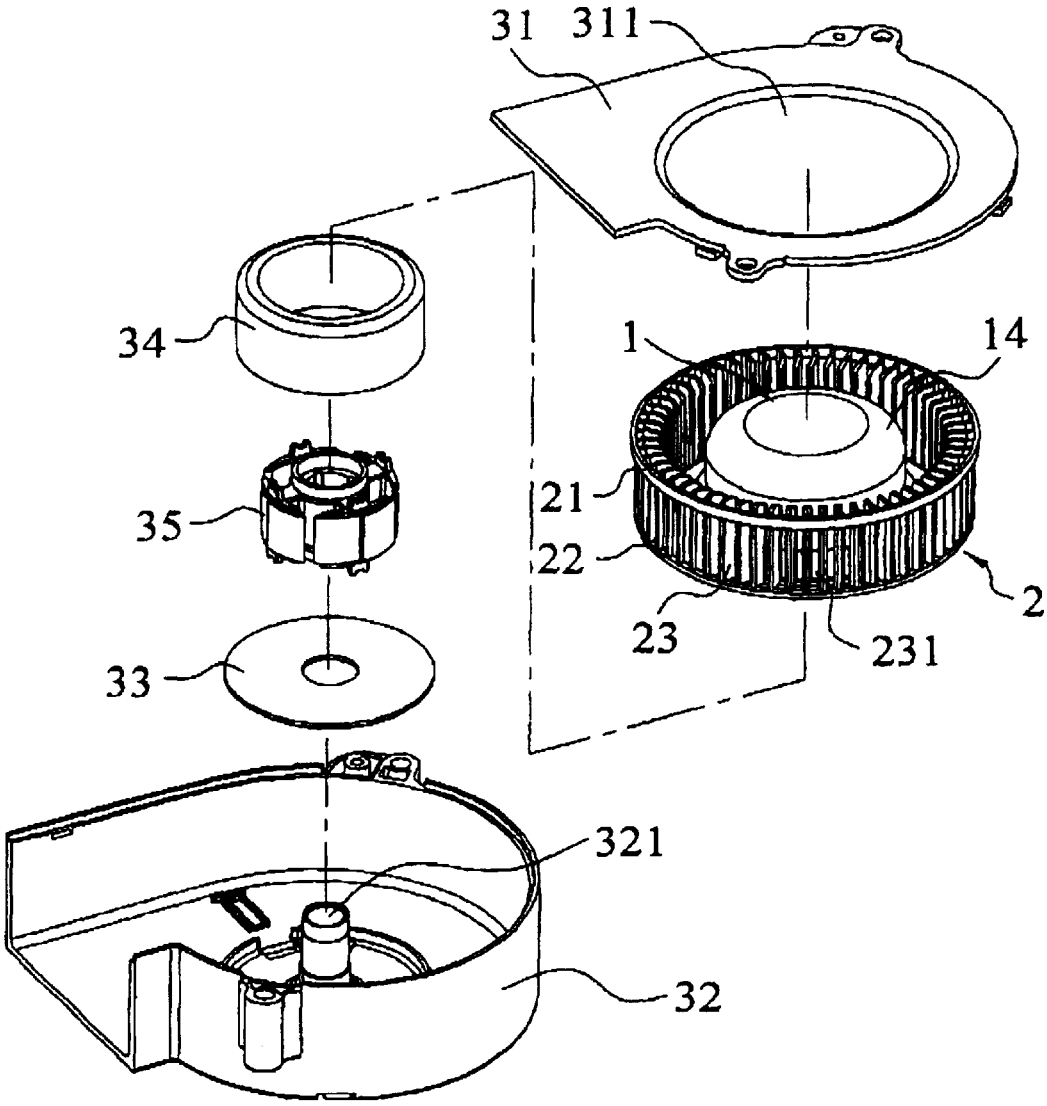
FIG. 5 is a separation diagram showing an outward appearance of the present invention fabricated in a case.
Figure 6:
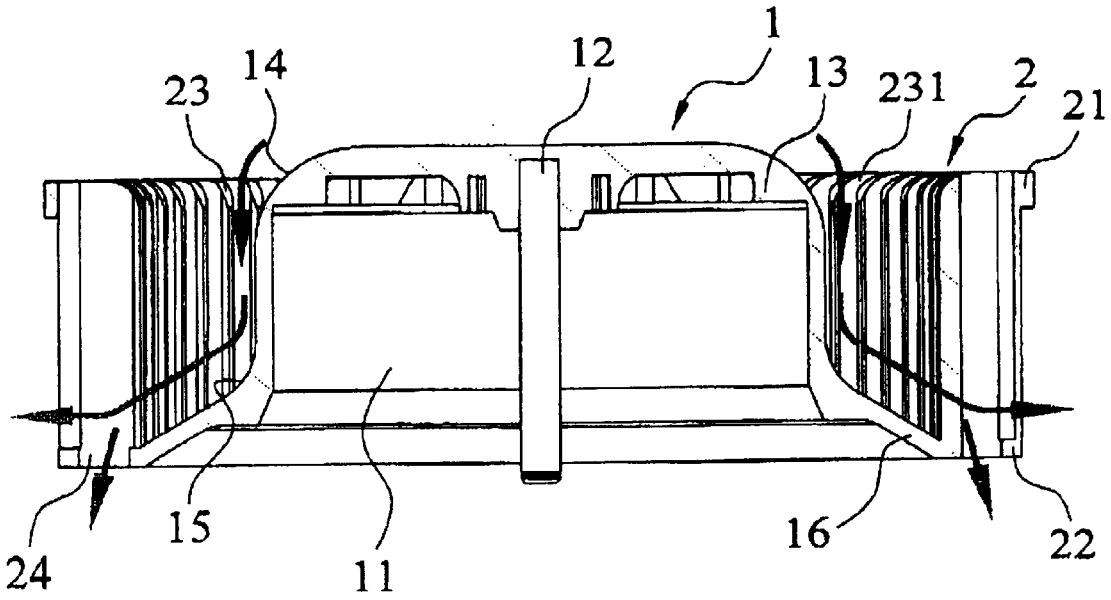
FIG. 6 is a cross-section diagram showing a view in operation configuration of the present invention.

FIG. 1, FIG. 2, and FIG. 3 are respectively a diagram showing an outward appearance of the present invention, a diagram showing an outward appearance of the present invention viewing from a different angle, and a cross-section diagram of the present invention. As shown in the diagrams, the present invention provides a modified centrifugal fan wheel, comprising a hollow hub 1 having a closed part 16 and a set of blades 2 having perforations 24. By the closed part 16 and the perforation 24, low noise and low current are provided. Meanwhile, power consumption is reduced and working performance of the fan wheel is also improved.

The hollow hub 1 mention above has a hollow portion 11. A hollow hub axis 12 is disposed at the center of the hollow portion 11 of the hollow hub 1. Ribs 13 are disposed at the hollow portion 11 of the hollow hub 1 close to the hollow hub axis 12 for strengthening the structure of the hollow hub 1. Along a top side surface of the hollow hub 1 is a curved guiding inlet part 14 and along a bottom side surface of the hollow hub 1 is a curved surface 15 with a smooth fillet extending to the closed part 16.

The set of blades 2 is arranged around an outer part of the hollow hub 1, having an up ring 21 and a down ring 22. An inner part of the down ring 22 is connected to the closed part 16 of the hollow hub 1. A plurality of blades 23 are disposed between the up ring 21 and the down ring 22. Wind holes 231 are disposed equidistantly between each of the blades 23 and equidistant perforations 24 are arranged on the surface of the down ring 22, connecting to the wind holes 231 between each of the blades 23. Therefore, the present invention provides a novel modified centrifugal fan wheel.

FIG. 4, FIG. 5, FIG. 6, FIG. 7, and FIG. 8 are respectively a diagram showing an outward appearance of the present invention fabricated in a case, a separation diagram showing an outward appearance of the present invention fabricated in a case, a cross-section diagram showing a view in operation configuration of the present invention, a P-Q chart of the present invention and the prior art, and a noise value (db) comparison chart of the present invention and the prior art. As shown in the diagrams, during operation, the fan wheel of the present invention is fabricated in a case 3 having a top cover 31 and a bottom cover 32. An outlet 36 is disposed at one end of the case 3. An inlet 311 is disposed on the surface of the top cover 31 and a bearing 321 is disposed on the bottom cover 32. A circuit board 33 is also disposed on the bottom cover 32 for providing and regulating required power. A magnetic means 34 is disposed in the hollow portion 11 of the hollow hub 1 and a coil winding set 35 is disposed outside the bearing 321 of the bottom cover 32. The hollow hub axis 12 of the hollow hub 1 is disposed the bearing 321 of the bottom cover 32. The coil winding set 35 is disposed in the magnetic means 34 of the hollow hub 1. Therefore, the structure of the fan wheel is corresponding to the inlet 311 on the surface of the top cover 31.

Figure 7:
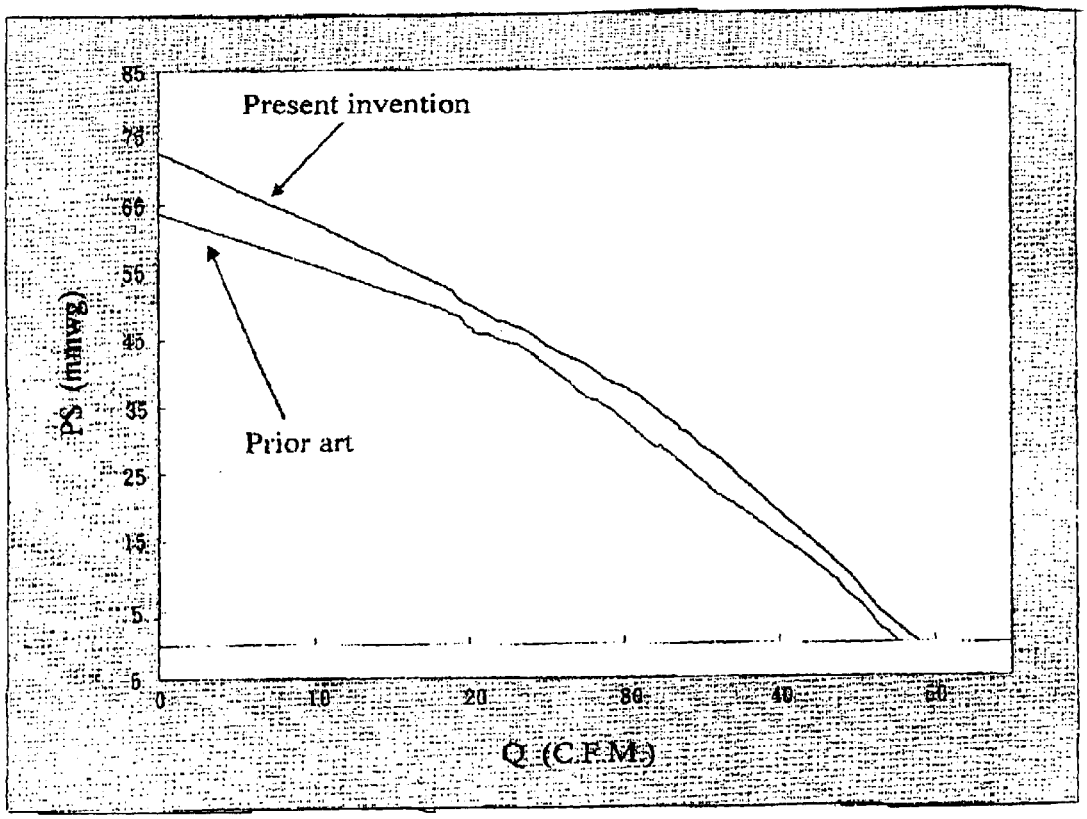
FIG. 7 is a P-Q chart of the present invention and the prior art.
Figure 9:
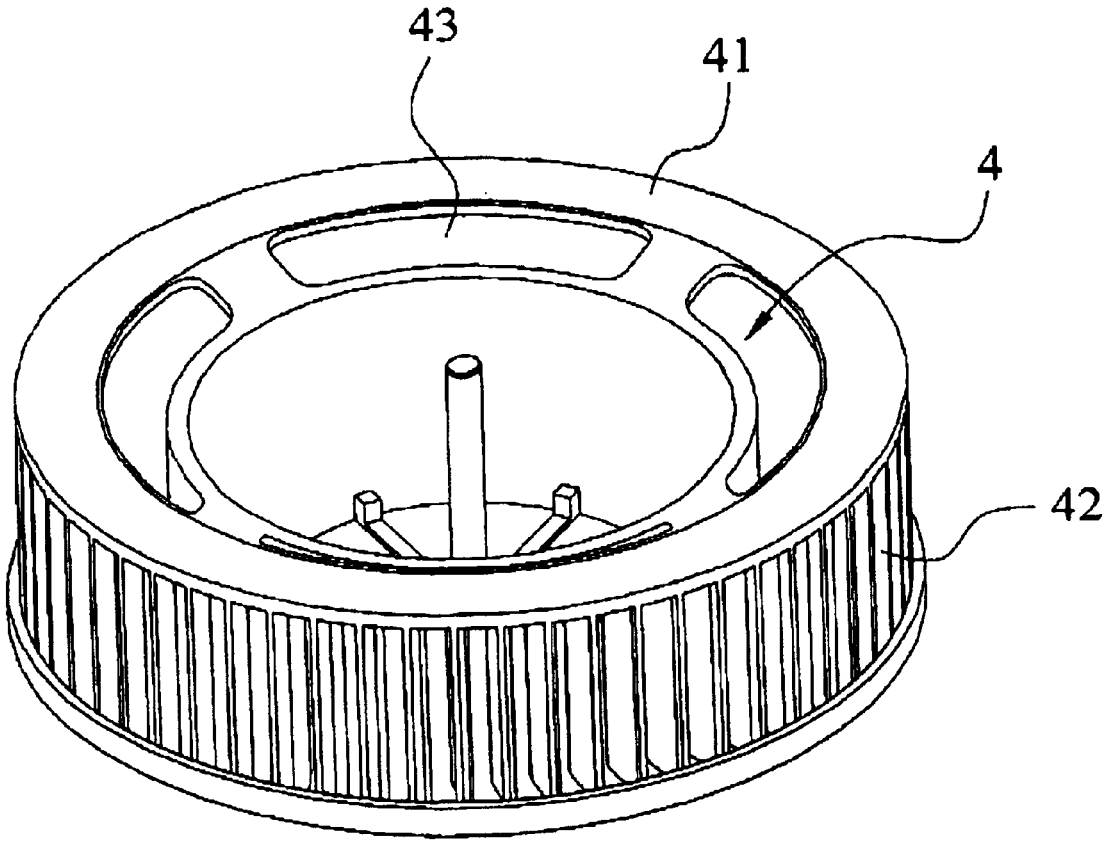
Fig. 9 (Prior Art)
FIG. 9 is a diagram showing an outward appearance of the prior art.
Figure 10:
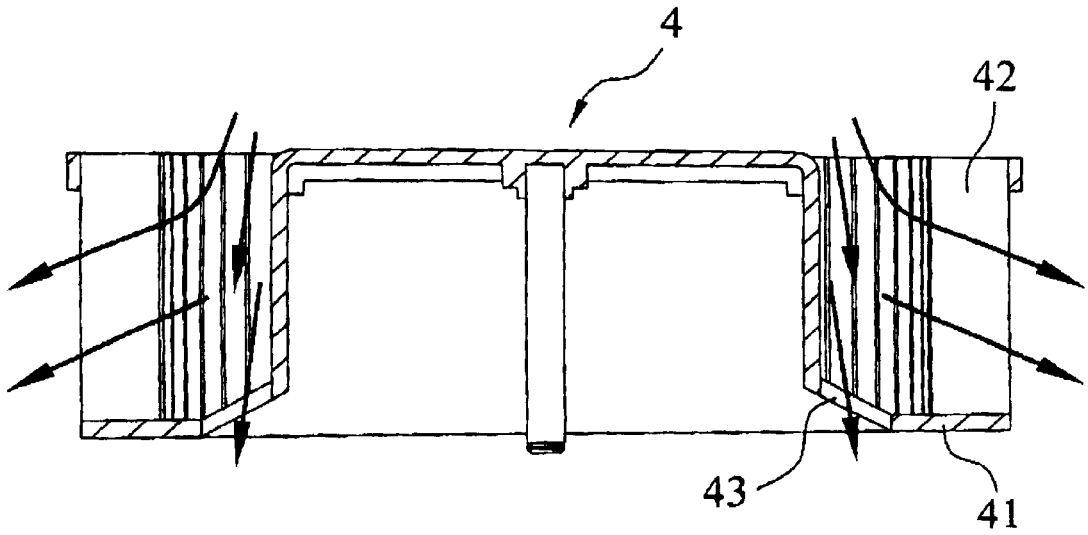
Fig. 10 (Prior Art)
FIG. 10 is a cross-section diagram in operation configuration of the prior art.

During operation, the airflow enters from the inlet 311 on the surface of the top cover 31 of the case 3. After entering, the airflow is guided by the curved guiding inlet part 14 on the top side of the hollow hub 1, so that airflow will be guided to blow toward the bottom of the hollow hub 1. When airflow is guided to the bottom of the hollow hub 1, by means of the curved surface 15 arranged on the bottom side of the hollow hub 1, airflow is guided to the closed part 16 along the side of the curved surface 15, and therefore airflow will blow through the closed part 16 toward the wind hole 231 between the up ring 21 and the down ring 22 of the set of blades 2. By the perforation 24 on the surface of the down ring 22, more airflow will be outputted. Moreover, by the plurality of blades 23 between the up ring 21 and the down ring 22, airflow is guided out from the outlet 36 in one end of the case 3. Accordingly, from the P-Q chart, the fan wheel of the present invention has better performance than prior art. FIG. 7 shows a P-Q chart of the present invention and the prior art. The reduced power consumption during operation and the increased working performance adopt the data measured by the ASHRAE standard 51-1985 fan test equipment manufactured by Engineering Laboratory Design INC. From the measured P-Q chart, the present invention can increase airflow by the arrangement of the curved guiding inlet part 14, the curved surface 15, the closed part 16, and the perforation 24. Therefore, from the P-Q chart, the fan wheel of the present invention has better performance than prior art. Furthermore, a noise test between the present invention and the prior art is performed in a semi anechoic room (with five wall closed by noise separation cotton, no noise separation cotton on the ground, ground noise is 10–17 db). The environment of the room conforms to the standard ISO 3745 appendix A and the measuring method conforms to the standard ISO 7779. The measured data is shown in FIG. 8. From the above two tests, it is clear that the present invention, by the arrangement of the curved guiding inlet part 14, the curved surface 15, the closed part 16, and the perforation 24, truly can achieve the objective of reducing the noise, lowering the current value during operation and meanwhile reducing the power consumption and increasing the working performance.

The description mention above is only a preferred embodiment of the present invention, which is not a limitation to the scope of the claimed invention. Therefore, any modification and variation in according with the claims and the specification of the present invention shall be covered within the scope of the present invention.

What is claimed is:

1. A centrifugal fan wheel comprising:

a) a hollow hub having:

i) a hollow portion;

ii) a hollow hub axis connected to a top of the hollow hub at a center of the hollow portion protruding toward a bottom of the hollow hub;

iii) a closed part located on the bottom of the hollow hub;

iv) a curved guiding inlet part located on a side of the hollow hub; and v) a curved surface located between the closed part and the curved guiding inlet part and having a smooth fillet extending to the closed part; and b) a set of blades located on an exterior of the hollow hub and having:

i) an up ring located on a top of the set of blades;

ii) a down ring located on a bottom of the set of blades and having an inner part connected to the closed part of the hollow hub and a plurality of perforations located through a bottom thereof, each of the plurality of perforations is spaced apart an equal distance;

iii) a plurality of blades located between the up ring and the down ring, each of the plurality of blades is spaced apart an equal distance; and iv) a plurality of wind holes located between the plurality of blades;

wherein each of the plurality of wind holes communicating with an exterior of the bottom of the set of blades through one the plurality of perforations.

2. The centrifugal fan wheel according to claim 1, further comprising a plurality of ribs extending radially for the center of the hollow portion on the interior of the hollow hub.

* * * * *